US005452192A

United States Patent [19]

Yurich

[11] Patent Number: 5,452,192

[45] Date of Patent: Sep. 19, 1995

[54] LUMINAIRE HAVING HARD WIRING

[76] Inventor: Gary D. Yurich, 328 E. Sunnybrook, Royal Oak, Mich. 48073

[21] Appl. No.: 162,709

[22] Filed: Dec. 6, 1993

[51] Int. Cl.[6] ..... F21V 21/00

[52] U.S. Cl. ..... 362/346; 362/376; 362/407; 362/453

[58] Field of Search ..... 362/296, 350, 376, 404, 362/407, 147, 341, 346, 453

[56] References Cited

U.S. PATENT DOCUMENTS

| | | | |
|---|---|---|---|
| 939,062 | 11/1909 | Mygatt . | |
| 988,824 | 4/1911 | Sagendorph . | |
| 1,875,981 | 9/1932 | Blau . | |
| 4,621,310 | 11/1986 | Keating | 362/376 |
| 4,701,832 | 10/1987 | Lasker | 362/281 |
| 4,974,137 | 11/1990 | Evans, Jr. et al. | 362/300 |

FOREIGN PATENT DOCUMENTS

| | | | |
|---|---|---|---|
| 587347 | 1/1925 | France | 362/346 |
| 702270 | 1/1931 | France | 362/407 |
| 759148 | 11/1933 | France | 362/404 |

OTHER PUBLICATIONS

Hanglite TM Brochure, DAFT Electrical Supplies and Services, Inc.

*Primary Examiner*—Ira S. Lazarus
*Assistant Examiner*—Sara Sachie Raab
*Attorney, Agent, or Firm*—Howard & Howard

[57] ABSTRACT

A luminaire (10) for dispersing light upwardly comprises a reflecting bowl (11) and an electric light socket (12) disposed in the bowl adjacent the closed end for energizing a light bulb (34). A power cord (14) supplies electrical power from a point external the luminaire to the socket (12), the power cord extending between the open end of the reflecting bowl (11) and the closed end, with the power cord (14) being connected to the socket (12). A rigid safety conduit (16) encases the power cord (14) as the power cord extends between the open end and the socket (12) for maintaining the power cord in a position fixed with respect to the reflecting bowl (11). The luminaire (10) further includes a funnel-shaped reflecting surface (42) disposed within the luminaire adjacent the light source (36) for increasing light reflected from the luminaire.

19 Claims, 2 Drawing Sheets

LUMINAIRE HAVING HARD WIRING

TECHNICAL FIELD

The subject invention relates to luminaires of the type including a light source and a reflective cover surrounding the light source for emitting light in a predetermined pattern.

BACKGROUND OF THE INVENTION

Indirect lighting is beneficial in a number of environments, including indoor sports facilities. Such environments require intense, evenly balanced light to optimize the performance of people playing or working in the facility.

Such facilities are occasionally lit by lights which cast light directly down onto the sports playing surface. In other words, the light faces down onto the playing surface. This is undesirable because of the glare produced: a player's vision will be impaired if the player looks into the bright light source.

Such a problem is overcome by casting light onto a reflective ceiling with a number of lamps which are hung or otherwise supported near the ceiling. These lamps include a reflective cover, usually bowl-shaped, with an opening in the cover facing the ceiling. Because the light bulbs are effectively concealed by the covers, the vision of persons playing in the facility will not be impaired by looking into a bright light source.

Some of the lamps of this type place the light socket in the opening of the cover, or on the side of the cover. U.S. Pat. No. 4,974,137 to Evans, Jr. et al and U.S. Pat. No. 4,701,832 to Lasker, respectively, teach these arrangements. Unfortunately, the socket mounted in either of these arrangements will interfere with or block light reflected out of the open end of the cover.

Thus, the most efficient systems mount the socket in the closed end of the cover, i.e. away from the opening, and thus minimize the amount of light blocked by electrical components. This can present other difficulties, however. If the light is suspended from a ceiling and the power cord for the light also comes from the ceiling, the power cord must run from the ceiling to the lamp cover and then along either the inside or outside of the cover toward the closed end where the socket is mounted. This wiring arrangement is both unsightly and, in some jurisdictions, against the building codes.

SUMMARY OF THE INVENTION AND ADVANTAGES

A luminaire for dispersing light comprises a reflecting bowl including a closed end, an open end and at least one interior surface extending therebetween. An electric light socket is disposed in the bowl adjacent the closed end for energizing a light bulb from electrical power. A power cord supplies electrical power from a point external the luminaire to the socket, the power cord extending between the open end of the reflecting bowl and the closed end, the power cord being connected to the socket. The assembly is characterized by a rigid safety conduit encasing the power cord as the power cord extends between the open end and the socket for maintaining the power cord in a position fixed with respect to the reflecting bowl.

This rigid conduit in effect "hard wires" the luminaire, rendering it more aesthetically pleasing and at the same time, bringing the luminaire into compliance with building codes.

The luminaire comprises another novel feature. A light bulb includes a socket end contacting the socket and a light source which converts electric power into light, the light source including a top end and a bottom end, with the bottom end being spaced apart from the socket end a predetermined distance. The reflecting bowl includes a reflecting side wall extending from the open end toward the closed end. A first reflecting surface extends between an outer edge and an inner edge, the outer edge being adjacent the side wall and the inner edge being adjacent the bottom end of the light source for reflecting light from the light source out of the reflecting bowl. A second reflecting surface extends from the inner edge of the reflecting surface toward the closed end of the reflecting bowl. The luminaire is characterized by the first reflecting surface having the shape of a funnel extending upwardly and outwardly from its inner edge toward its outer edge whereby the light emitting from the open end of the reflecting bowl is increased.

Practitioners constantly seek new ways to increase efficiency of lighting assemblies. By using a funnel-shaped reflecting surface adjacent the light source instead of a flat annulus, light output is increased to the point that fewer light fixtures may be needed to light a facility of a given size.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
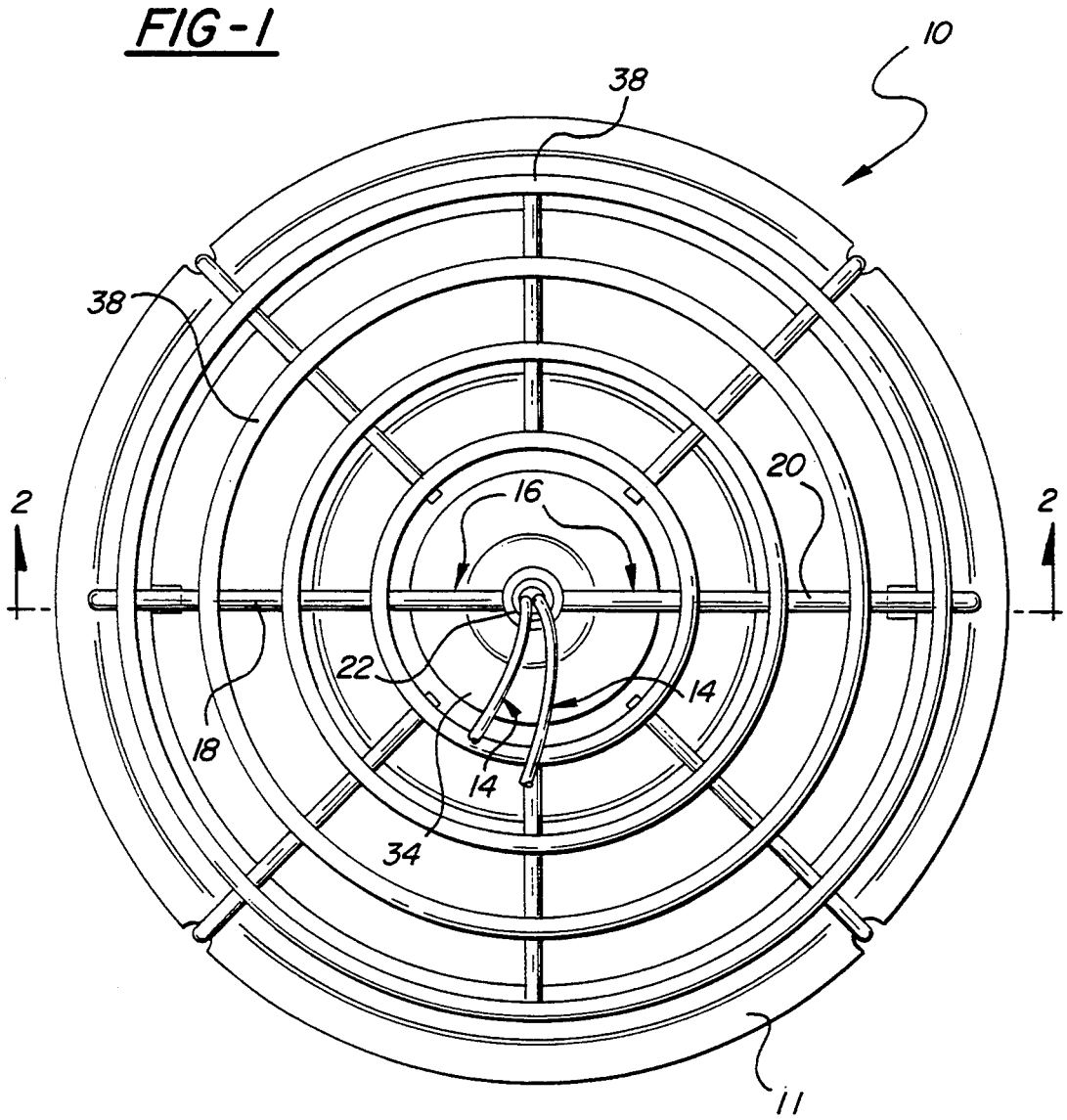
FIG. 1 is a top view of the luminaire showing a protective cage over the open end of the luminaire.
Figure 2:
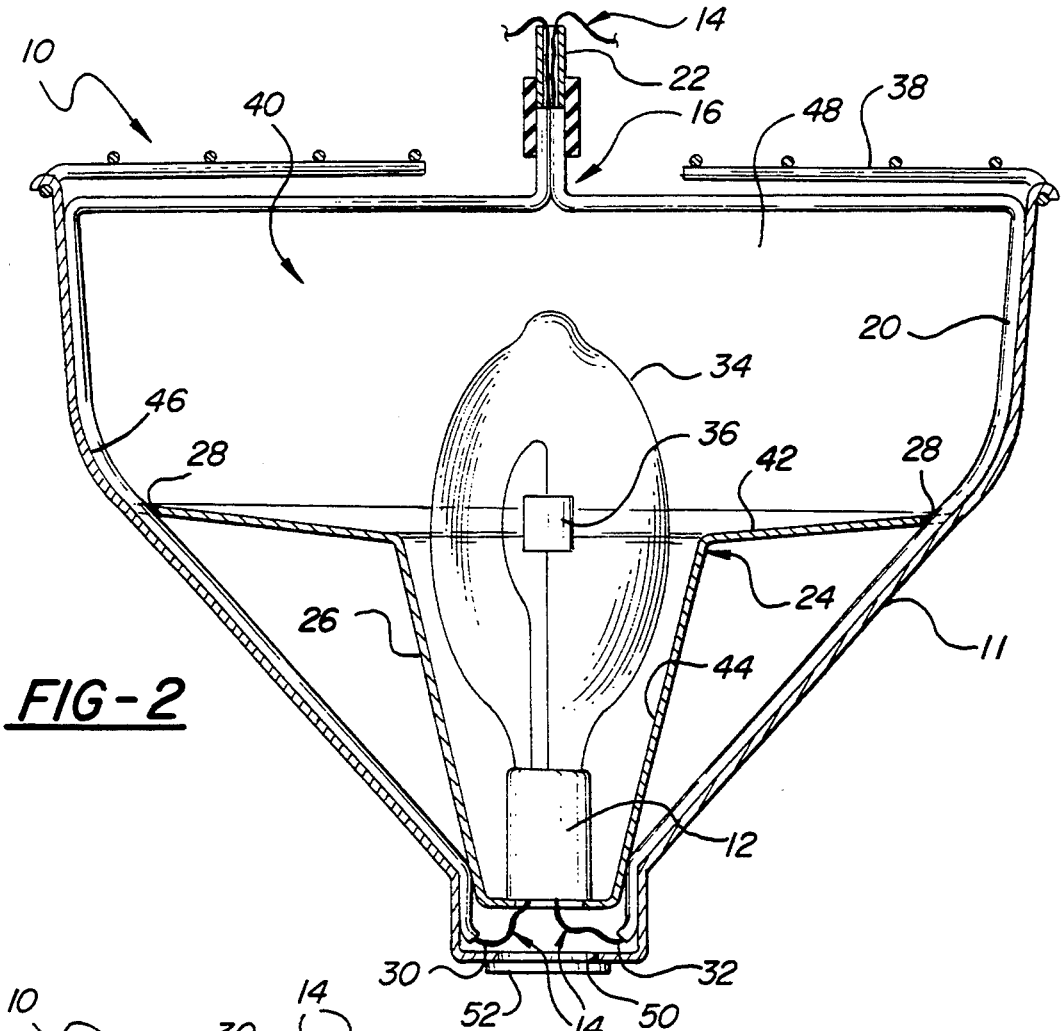
FIG. 2 is a cross-sectional view of the luminaire taken along line 2—2 of FIG. 1.
Figure 3:
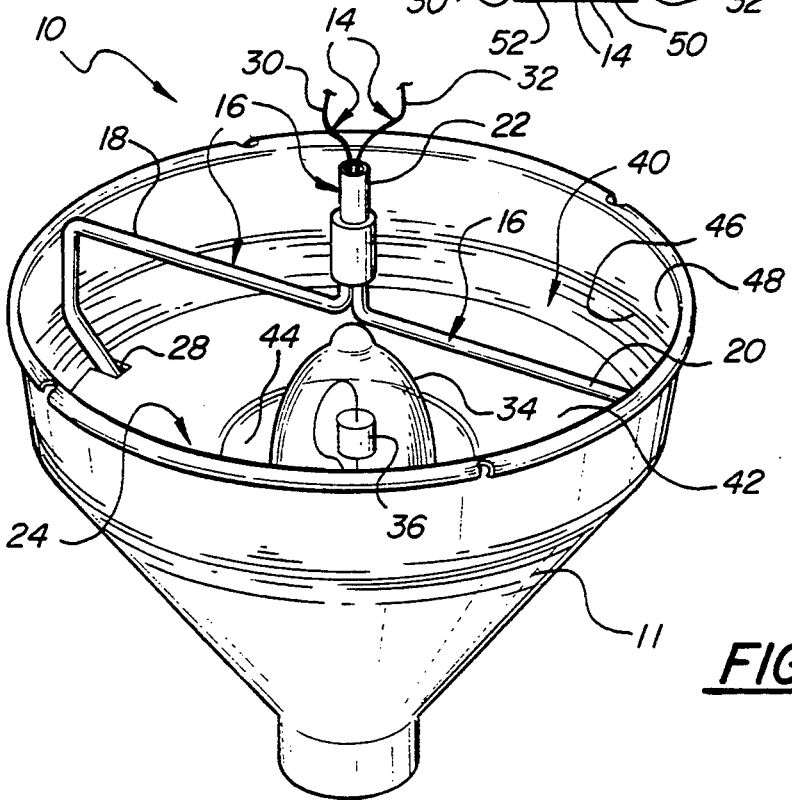
FIG. 3 is a perspective view of the luminaire with the protective cage removed to show the inside of the luminaire.

Referring to the Figures wherein like numerals indicate like or corresponding parts throughout the several views, a luminaire is generally shown at 10.

The luminaire 10 comprises a reflecting bowl 11 including a closed end, an open end and at least one interior surface generally indicated at 40 extending therebetween. An electric light socket 12 is disposed in the bowl 11 adjacent the closed end for energizing a light bulb from electrical power. A power cord generally indicated at 14 supplies electrical power from a point external the luminaire 10 to the socket 12, the power cord 14 extending between the open end of the reflecting bowl 11 and the closed end, with the power cord 14 being connected to the socket 12. The luminaire 10 is characterized by a rigid safety conduit generally indicated at 16 encasing the power cord 14 as the power cord extends between the open end and the socket 12 for maintaining the power cord in a position fixed with respect to the reflecting bowl 11.

The rigid conduit 16 includes a first section 18 extending between the socket 12 and the open end of the reflecting bowl 11 and a second section 20 extending parallel to the first section 18 between the socket and the open end of the reflecting bowl 11. The first and second sections 18,20 are spaced from one another one hundred eighty (180) degrees about the reflecting bowl 11. In effect, these two sections 18,20 comprise a bracket by which the luminaire may be supported.

The first and second sections 18,20 each extend up the interior surface 40 of the bowl 11 and across the open end toward toward one another to juxtaposed ends. The first and second sections 18,20 meet in the center of the space defined by the bowl 11 just below the opening and well above the socket 12 so that the bulb 34 may be easily inserted or removed. The rigid conduit 16 includes a support section 22 extending away from the juxtaposed ends of the first and second sections 18,20 for supporting the luminaire 10 from a support structure. All sections of the rigid conduit 16 are made from metal tubing, typically copper.

The rigid conduit 16 essentially "hard wires" the luminaire 10. In the prior art, the electrical power cord simply hung from the ceiling and ran along the outside of the luminaire 10—a situation both unsafe and aesthetically unpleasing. Now the power cord 14 runs through the conduit 16 where it is protected, enclosed and retained in a fixed relationship with respect to the luminaire 10.

A reflecting insert generally indicated at 24 comprises at least one reflecting surface for reflecting light out of the open end of the bowl 11. The reflecting insert 24 extends across the bowl 11 so that the insert and a lower portion of the interior surface define an enclosed space 26. The socket 12 is supported on the insert 24 a predetermined distance from the closed end of the bowl 11. Thus, there is an enclosed space 26 which extends from below the socket 12 up the sides of the luminaire 10 to the point where the outer edge of the insert 24 meets the interior surface. This enclosed space 26 provides an additional way to conceal the wiring, i.e. power cord 14, of the luminaire 10.

The first and second sections 18,20 of the rigid conduit 16 extend over the interior surface 40 of the bowl 11 through holes 28 in the reflecting insert 24 and into the enclosed space 26 toward the socket 12. By running the conduit 16 through the inside of the bowl 11, one can improve the appearance of the luminaire 10 as viewed from the outside.

The power cord 14 includes first and second electrical wires 30,32 extending separately from the socket 12 into the enclosed space 26, through the first and second sections 18,20, respectively, and then together through the support section 22. The wires 30,32 of the power cord 14 are the insulated type of wire as is commonly used in the art.

The luminaire 10 includes a light bulb 34 disposed in the light socket 12. The light bulb 34 includes a socket end contacting the socket 12 and a light source 36 which converts electric power into light. The preferred light bulb 34 is a 1000 watt metal halide bulb. The light source 36 includes a top end and a bottom end, with the bottom end being spaced apart from the socket end a predetermined distance. The light source 36 in this bulb is a tube of gas or vapor which emits light when the electrons in the gas are excited by passing an electrical current through the tube. In general, the light source 36 may also be a filament in a light bulb of the type including a filament.

Cover means 38 extends across the open end of the reflecting bowl 11 for protecting the light bulb 34. The first and second sections 18,20 of the rigid conduit 16 converge below the cover means 38. The cover means 38 includes a cage of rigid material, typically metal.

The interior surface of the reflecting bowl 11 is bowl-shaped and includes reflective material as is commonly used in the art for reflecting light out of the luminaire 10.

The bowl 11, as noted above, includes an interior surface or, in other words, a reflecting side wall 40 extending from the open end toward the closed end. A first reflecting surface 42 extends between an outer edge and an inner edge, the outer edge being adjacent the side wall 40 and the inner edge being adjacent the bottom end of the light source 36. This reflects light from the light source 36 out of the reflecting bowl 11. The inner edge of the first reflecting surface is positioned as close to the bottom edge of the light source 36 as possible to reflect the maximum amount of light out of the luminaire 10. If a plane runs through the bottom of the light source 36 perpendicular to the light source, the inner edge should be at this plane, and not significantly above or below it. The inner edge should also be as close to the bulb 34 as possible. A second reflecting surface 44 extends from the inner edge of the reflecting surface toward the closed end of the reflecting bowl 11. The luminaire 10 is characterized by the first reflecting surface 42 having the shape of a funnel extending upwardly and outwardly from the inner edge toward the outer edge whereby the light emitting from the open end of the reflecting bowl 11 is increased. In other words, the outer edge is higher, i.e. closer to the open end of the luminaire 10, than the inner edge so that the first reflecting surface 42 is slightly angled with respect to the light bulb 34 and the interior surface of the luminaire 10. In the prior art the first reflecting surface 42 is substantially flat, having the shape of an annulus.

The reflecting side wall 40 includes a concave surface 46 adjacent the outer edge of the first reflecting surface 42 and a funnel reflecting surface 48 having the shape of a funnel extending upwardly and outwardly from the concave surface 46 toward the open end. The concave surface 46 can also be thought of as a curved surface, i.e. having an arc with a predetermined sweep and radius which interconnects or extends between the first reflecting surface 42 and the funnel reflecting surface 48. This curved surface reflects more light from the light source 36 than would a corner or elbow formed by the intersection of the first reflecting surface 42 and the funnel reflecting surface 48. The funnel reflecting surface 48 has the general shape of a funnel in that its walls angle inwardly from top to bottom; but, as shown in the drawings, the walls of this reflecting surface are nearly vertical. In other words, the top of the reflecting bowl 11 flares open slightly to allow more light to escape from the bowl than if the upper walls of the bowl were perfectly vertical.

The reflecting insert 24 referred to above comprises the first reflecting surface 42 and the second reflecting surface 44. The reflecting insert 24 and the reflecting bowl 11 together define the enclosed space 26.

The second reflecting surface 44 has the shape of a funnel extending downwardly and inwardly from the inner edge of the first reflecting surface 42. The socket 12 is mounted in the base of this funnel-shaped second reflecting surface 44.

The reflecting bowl 11 and the reflecting insert 24 are both made from aluminum. There is also a reflective coating on the reflecting bowl 11 and the reflecting insert 24. This is the typical coating as is used and well-known in the art.

The subject luminaire 10 has two main embodiments: one which is hung or otherwise supported from a support structure such as a ceiling; and one which can be supported on top of or directly under a support beam which is itself supported a predetermined distance from the surface illuminated by the luminaires.

The hanging embodiment is typically hung from its open end. In other words, a chain or other support means attaches at one end to the ceiling and at its other end to the open end of the luminaire 10—either to the edge of the opening or elsewhere. The preferred support means is the support section 22 of the rigid conduit 16 which extends from the open end of the luminaire to the support structure. In this case, no chains or other means are necessary to provide further support. The support section 22 of the conduit 16 both supports the luminaire 10 and conducts the wires 30,32 from the luminaire to the support structure. This embodiment may include an opening 50 at the closed end of the luminaire 10 beneath the socket 12 to allow access to the wires 30,32 leading from the socket 12 to the sections of the rigid conduit 16. There will also be a cover 52 for covering the opening 50 when access is not needed.

The other embodiment is mounted on a beam in either a facing up or facing down position. In contrast to the case of the hanging embodiment, the luminaire 10 here is mounted at its closed or bottom end to the beam. This embodiment includes an opening 50 in the closed end to allow the wires 30,32 from the socket 12 to pass through to the beam, along which the wiring may be concealed. Obviously, this embodiment has no need for the rigid conduit 16 to cover and protect the electrical wiring because the wiring here does not extend from the socket 12 to the open end of the luminaire 10. Accordingly, this embodiment does not include the rigid conduit 16.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

We claim:

1. A luminaire (10) for dispersing light comprising:

a reflecting bowl (11) including a closed end, an open end and at least one interior surface (40) extending therebetween;

an electric light socket (12) disposed in said bowl (11) adjacent said closed end for energizing a light bulb (34) from electrical power;

a power cord (14) for supplying electrical power from a point external said luminaire (10) to said socket (12), said power cord (14) extending between said open end of said reflecting bowl (11) and said closed end, said power cord (14) being connected to said socket (12);

characterized by a rigid safety conduit (16) encasing said power cord (14) as said power cord extends between said open end and said socket (12) for maintaining said power cord in a position fixed with respect to said reflecting bowl (11); and a platform (24) extending across said bowl so that said platform and a lower portion of said interior surface define an enclosed space (26), said socket (12) being supported on said platform (24) and suspended a predetermined distance above said closed end of said bowl (11).

2. A luminaire as set forth in claim 1 further characterized by said closed end of said reflecting bowl defining an access opening (50).

3. A luminaire as set forth in claim 2 further characterized by a cover (52) closing said access opening.

4. A luminaire (10) as set forth in claim 3 further characterized by said rigid conduit (16) being disposed over said interior surface of said bowl (11) through said platform (24) and into said enclosed space (26) toward said socket (12).

5. A luminaire (10) as set forth in claim 1 further characterized by said rigid conduit (16) including a first section (18) extending between said socket (12) and said open end of said reflecting bowl (11) and a second section (20) extending parallel to said first section (18) between said socket (12) and said open end of said reflecting bowl (11), said first and second sections (18,20) being spaced from one another about said reflecting bowl.

6. A luminaire (10) as set forth in claim 5 further characterized by said first and second sections (18,20) each extending up said interior surface and across said open end toward toward one another to juxtaposed ends.

7. A luminaire (10) as set forth in claim 3 further characterized by said rigid conduit (16) including a support section (22) extending away from said juxtaposed ends of said first and second sections (18,20) for supporting said luminaire (10) from a support structure.

8. A luminaire (10) as set forth in claim 7 further characterized by said power cord (14) including first and second electrical wires (30,32) extending separately from said socket (12) into said enclosed space (26), through said first and second sections (18,20), respectively, and then together through said support section (22).

9. A luminaire (10) as set forth in claim 6 further characterized by including a light bulb (34) disposed in said light socket (12).

10. A luminaire (10) as set forth in claim 9 further characterized by cover means (38) disposed across said open end of said reflecting bowl (11) for protecting said light bulb (34), said first and second sections (18,20) of said rigid conduit (16) converging below said cover means (38).

11. A luminaire (10) as set forth in claim 10 further characterized by said cover means (38) including a cage of rigid material.

12. A luminaire (10) as set forth in claim 1 further characterized by said rigid conduit (16) including metal tubing.

13. A luminaire (10) as set forth in claim 1 further characterized by said platform including reflective material for reflecting light out of said luminaire (10).

14. A luminaire (10) for area lighting comprising:

a reflecting bowl (11) having a closed end and an open end;

a light socket (12) disposed in said bowl (11) adjacent said closed end;

power supply means (14) for supplying electrical power to said socket (12);

a light bulb (34) including a socket end contacting said socket (12) and a light source (36) which converts electric power into light, said light source (36) including a top end and a bottom end, said bottom end being spaced apart from said socket end a predetermined distance;

said reflecting bowl (11) including a reflecting side wall (40) extending from said open end toward said closed end;

a first reflecting surface (42) extending between an outer edge and an inner edge, said outer edge being adjacent said side wall (40) and said inner edge being adjacent said bottom end of said light source (36) for reflecting light from said light source out of said reflecting bowl (11);

a second reflecting surface (44) extending from said inner edge of said first reflecting surface (42) toward said closed end of said reflecting bowl (11);

said first reflecting surface (42) having the shape of a funnel extending upwardly and outwardly from said inner edge toward said outer edge; and said second reflecting surface (44) having the shape of a funnel extending downwardly and inwardly from said inner edge of said first reflecting surface (42).

15. A luminaire (10) as set forth in claim 14 further characterized by said side wall (40) including a concave surface (46) adjacent said outer edge of said first reflecting surface (42) and a funnel reflecting surface (48) having the shape of a funnel extending upwardly and outwardly from said concave surface (46) toward said open end.

16. A luminaire (10) as set forth in claim 14 further characterized by a reflecting insert (24) comprising said first reflecting surface (42) and said second reflecting surface (44), said reflecting insert (24) and said reflecting bowl (11) defining an enclosed space (26).

17. A luminaire (10) as set forth in claim 16 further characterized by said reflecting insert (24) being made from aluminum.

18. A luminaire (10) as set forth in claim 16 further characterized by a reflective coating on said reflecting bowl (11) and said reflecting insert (24).

19. A luminaire (10) as set forth in claim 14 further characterized by said reflecting bowl (11) being made from aluminum.

* * * * *